US006175073B1

(12) United States Patent
Kitayama

(10) Patent No.: US 6,175,073 B1
(45) Date of Patent: Jan. 16, 2001

(54) TONE SYNTHESIZING DEVICE AND METHOD BASED ON PHYSICAL MODEL TONE GENERATOR

(75) Inventor: Toru Kitayama, Hamamatsu (JP)

(73) Assignee: Yamaha Corporation, Hamamatsu (JP)

( * ) Notice: Under 35 U.S.C. 154(b), the term of this patent shall be extended for 0 days.

(21) Appl. No.: 09/356,733

(22) Filed: Jul. 19, 1999

(30) Foreign Application Priority Data

Jul. 27, 1998 (JP) ..... 10-210936

(51) Int. Cl.[7] ..... G10H 1/12; G10H 5/00; G10H 5/02

(52) U.S. Cl. ..... 84/661; 84/622; 84/659

(58) Field of Search ..... 84/622–627, 659–663, 84/DIG. 9

(56) References Cited

U.S. PATENT DOCUMENTS

| | | | | |
|---|---|---|---|---|
| 5,157,218 | | 10/1992 | Kunimoto et al. | 84/659 |
| 5,286,914 | * | 2/1994 | Kunimoto | 84/625 |
| 5,286,916 | | 2/1994 | Yamauchi | 84/661 |
| 5,477,004 | * | 12/1995 | Kunimoto et al. | 84/625 |
| 5,498,836 | * | 3/1996 | Toshifumi | 84/658 |
| 5,712,439 | * | 1/1998 | Toshifumi | 84/661 |

FOREIGN PATENT DOCUMENTS 3-185498 * 8/1991 (JP) .

5-232964 * 9/1993 (JP) .

* cited by examiner

*Primary Examiner*—Robert E. Nappi
*Assistant Examiner*—Marlon Fletcher
(74) *Attorney, Agent, or Firm*—Morrison & Foerster

(57) ABSTRACT

Physical model tone generator, which includes a loop section with a signal delay element, generates a driving signal by modifying a loop output signal from the loop in accordance with a performance parameter such as a bowing velocity, and introduces the generated driving signal to the loop. This way, the tone generator generates a tone signal with a characteristic controlled by the performance parameter, in a pitch period corresponding to a time delay of the loop. To generate the driving signal, a nonlinear conversion section performs a nonlinear conversion on an input signal based on the loop output signal and performance parameter. The conversion section switches an input-output characteristic, to be used for converting the input signal, into one of at least first and second input-output characteristics in accordance with intensity of a signal based on the loop output signal or the input signal, so that a desired nonlinear conversion characteristic is achieved. Control section restrains a period, in which the first input-output characteristic shifts to the second input-output characteristic, from becoming shorter than the pitch period of a tone based on the loop output signal. This arrangement can prevent the shift from the first input-output characteristic to the second input-output characteristic from taking place frequently within a single period of the tone pitch and thereby avoid a high-order vibration mode.

17 Claims, 7 Drawing Sheets

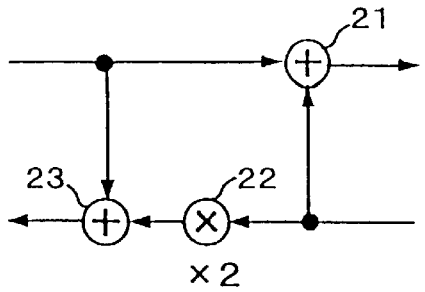
17 FIG. 2
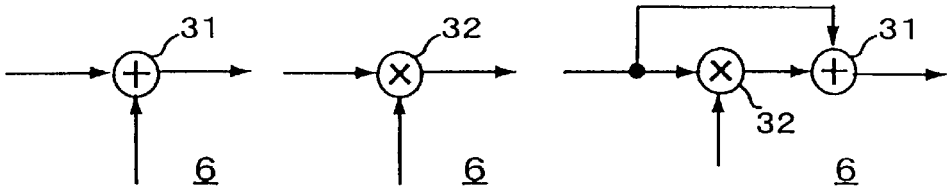
FIG. 3A FIG. 3B FIG. 3C
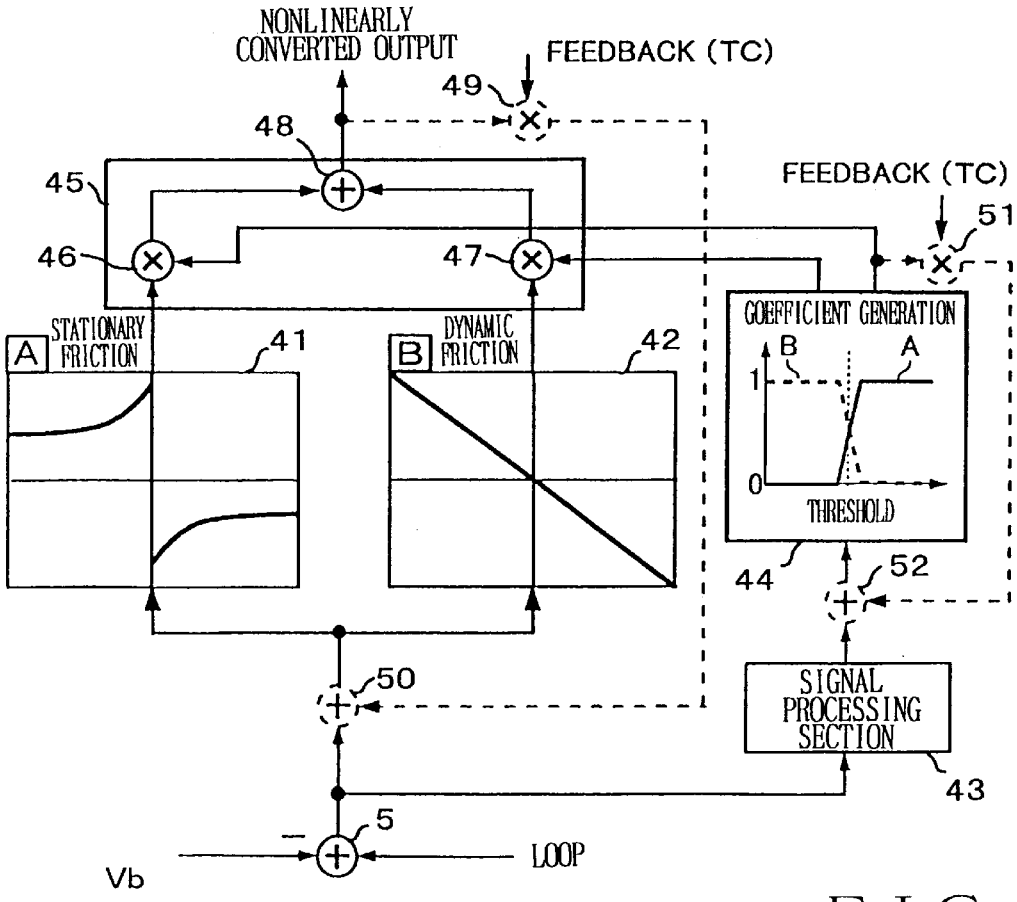
FIG. 4

TONE SYNTHESIZING DEVICE AND METHOD BASED ON PHYSICAL MODEL TONE GENERATOR

BACKGROUND OF THE INVENTION

The present invention relates to a tone synthesizing device and method based on a physical model tone generator simulating or modelling the tone generating mechanism of natural musical instruments, and a recording medium storing a tone synthesizing program. More particularly, the present invention relates to a tone synthesizing device designed to model the tone generating mechanism of rubbed string instruments such as a violin.

Physical model tone generators have been known which are designed to model the tone generating mechanism of natural musical instruments to thereby synthesize tones of the natural musical instruments or tone signals of an unreal musical instrument. In such a physical model tone generator modelling a rubbed string instrument, pitch information and performance information, such as a bowing pressure and bowing velocity, is manually input by use of a keyboard, pointing device, such as a mouse, and other necessary operator. Parameters to be used in the physical model tone generator are varied in response to the input information, to synthesize time-varying tone signals of a tone color or timbre similar to or exceeding that of the modelled natural musical instrument.

FIGS. 13A and 13B are block diagrams showing a conventional tone synthesizing device modelling a rubbed string instrument; more specifically, FIG. 13A shows a general organization of the tone synthesizing device while FIG. 13B shows an inner construction of a nonlinear section 133 in the tone synthesizing device. In these figures, reference numerals 10, 14 and 16 represent adders, 131 and 132 delay filters, 133 the nonlinear section, 134 a divider, 135 a nonlinear function section, and 136 a multiplier.

In FIG. 13A, the adders 10 and 14 correspond to a string-rubbing point of the rubbed string instrument, and the delay filter 131 functions to model propagation characteristics of a vibratory wave produced at the string-rubbing point, reaching the left end of the string and then reflected off the left end to return to the string-rubbing point. Similarly, the other delay filter 132 functions to model propagation characteristics of a vibratory wave created at the string-rubbing point, reaching the right end of the string and then reflected off the right end to return to the string-rubbing point. A closed loop is formed via these delay filters 131 and 132, and the resonant frequency of the string is determined by a delay time in the closed loop. These elements together constitute a linear unit of the tone synthesizing device. The nonlinear section 133 functions to model a frictional drive of the string by the bow. The adder 16 combines together signals corresponding to the vibratory waves propagating in the leftward and rightward directions and provides the resultant combined signal as a loop output signal LOOP. The loop output signal LOOP is modified in accordance with a bowing velocity Vb and bowing pressure Pb as performance parameters, and the thus-modified loop output signal LOOP is sent back to the linear unit via the adders 10 and 14.

Within the nonlinear section 133, as shown in FIG. 13B, the loop output signal LOOP supplied from the linear unit is given to an adder 5, where the bowing velocity Vb is subtracted from the loop output signal LOOP. After the subtraction, the loop output signal LOOP is divided by the bowing pressure Pb by means of the divider 134 and then passed to the nonlinear function section 135. Output from the nonlinear function section 135 is multiplied by the bowing pressure Pb by means of the multiplier 136.

FIG. 14 is a graph explanatory of an input-output characteristic of the nonlinear function section 135 shown in FIGS. 13A and 13B. In FIG. 14, the horizontal axis represents the input to the divider 134, i.e., a relative velocity between the loop output signal LOOP from the linear unit and the bowing velocity Vb (LOOP−Vb), while the vertical axis represents the output from the multiplier 136. The basic characteristics are determined by the nonlinear function section 135. Predetermined input range B, centering around the zero input level in FIG. 14, represents a situation where a driving force corresponding to a movement of the bow is being given to the string by a frictional engagement between the bow and the string. Thus, in this situation, the string presents a motion governed by a stationary friction coefficient.

However, when the bow is moved at a velocity within another input range A beyond the predetermined input range B, a slip would occur between the bow and the string, so that the string movement would be governed by a dynamic frictional coefficient smaller than the stationary friction coefficient and thus the driving force applied from the bow to the string would drop abruptly. As a consequence, the string would move back toward a free or undriven condition from the driven condition where it is being displaced in accordance with the movement of the bow. Therefore, a time interval between points at which the input range B causing the string to move with the stationary friction coefficient shifts to the input range A causing the string to move with the dynamic friction coefficient would have some connection to the period of the driving force that brings about vibration of the string. The boundary point between the input range B and the input range A would vary depending on the bowing pressure Pb. Namely, the greater the bowing pressure Pb, the greater becomes the relative velocity causing the slip between the bow and the string. The divider 134 and multiplier 136 cooperate with each other for modelling such a variation of the boundary point (characteristic changing point) responding to a variation of the bowing pressure Pb.

Further, with the rubbed string instruments typified by a violin, there would be generated an unintended "out-of-tune" tone through a certain bowing pressure or finger motion applied by a human player during the course of a bowing operation. This "out-of-tune" tone corresponds to a "falsetto" of a human singer and can be described as a physical phenomenon where the string vibration shifts from a fundamental vibration mode to a second-order (second harmonic) or higher-order vibration mode. Therefore, to keep generating tones of desired pitches in a stable manner requires a considerable performance skill on the part of a human player, due to dynamic variations in the frictional relationship, such as the above-mentioned slip, between the bow and the string.

The above-noted phenomenon would occur, for example, where the desired stationary frictional relationship, involving no slip between the string and the bow, frequently shifts to the dynamic frictional relationship due to occurrence of the slip. With the physical model tone generator modelling the tone generating mechanism of the rubbed string instrument as well, there could, in theory, occur a similar phenomenon of the fundamental vibration mode shifting to a higher-order vibration mode, particularly, depending on the parameter settings. In the illustrated example of FIG. 14, this phenomenon corresponds to such a condition where the period, in which the input range B where the string is caused to move with the stationary friction coefficient shifts to the input range A where the string is caused to move with the dynamic friction coefficient, becomes shorter than the fundamental pitch period.

In the violin, the bow is made of a bundle of horse's tail hair, and tones are generated with relatively rough fluctuations due to fine unevenness in the surfaces of the bow and the string. Thus, to faithfully approximate the tone color of the rubbed string instrument, it is necessary to impart the fluctuations to the tones. Tone synthesizing device capable of imparting such fluctuations is known from, for example, Japanese Patent Laid-open Publication No. HEI-4-306698, where tone parameters representing a bowing pressure are varied in accordance with random number signals. However, because the known tone synthesizing device is not designed to control the fluctuations in accordance with the string's vibrating movement and the like, it can not fully model the tonal fluctuations resulting from the surface conditions of the bow etc.

SUMMARY OF THE INVENTION

It is therefore an object of the present invention to provide a tone synthesizing device and method based on a physical model tone generator which can control a high-order vibration mode.

It is another object of the present invention to provide a tone synthesizing device and method based on a physical model tone generator which can impart fluctuations to tones.

To accomplish the above-mentioned objects, the present invention provides a tone synthesizing device which comprises: a loop section including at least a signal delay element; and a driving signal generation unit that generates a driving signal by modifying a loop output signal from the loop section in accordance with a performance parameter and supplying the generated driving signal to the loop section. The driving signal generation unit includes: a nonlinear conversion section that performs a nonlinear conversion on an input signal corresponding to the loop output signal and the performance parameter, the nonlinear conversion section switching an input-output characteristic, to be used for converting the input signal, into one of at least first and second input-output characteristics in accordance with intensity of a signal based on the loop output signal or the input signal; and a control section that restrains a period in which the input-output characteristic to be used for converting the input signal shifts from the first input-output characteristic to the second input-output characteristic from becoming shorter than a pitch period of a tone based on the loop output signal. In a preferred implementation, the first input-output characteristic is a predetermined input-output characteristic corresponding to small input signal levels, while the second input-output characteristic is a predetermined input-output characteristic corresponding to great input signal levels.

By the provision of the control section arranged to restrain the period, in which the input-output characteristic to be used for converting the input signal shifts from the first input-output characteristic to the second input-output characteristic, from becoming shorter than the pitch period of the tone based on the loop output signal, the present invention can effectively avoid a high-order vibration mode of the loop output signal that is likely to occur depending on various conditions, such as the vibrating state of the loop output signal and the way in which the performance parameter is given. Particularly, the inventive arrangements can prevent an unwanted "out-of-tone" or "falsetto-like" tone that would often occur in modelling a rubbed string instrument.

According to another aspect of the present invention, there is provided a tone synthesizing device which comprises: a loop section including at least a signal delay element; a driving signal generation unit that generates a driving signal by modifying a loop output signal from the loop section in accordance with a performance parameter and supplies the generated driving signal to the loop section; and a fluctuating-signal generation section that generates a fluctuating signal containing a frequency component corresponding to the loop output signal or corresponding to the loop output signal and the performance parameter and supplies the generated fluctuating signal to the loop section. The fluctuating-signal generation section may perform an arithmetic operation between the generated fluctuating signal and a second performance parameter and supplies a result of the arithmetic operation to the loop section. Further, the fluctuating-signal generation section may generate the fluctuating signal containing a frequency component corresponding to the intensity of the loop output signal or the intensity of the loop output signal and the performance parameter.

By generating the fluctuating signal containing such a frequency component corresponding to the loop output signal or corresponding to the loop output signal and the performance parameter and supplying the generated fluctuating signal to the loop section, energization or excitation of the loop section can be controlled with the fluctuating signal containing a frequency component related to the periodicity of the loop output signal to be output as a tone signal or the performance parameter such as the movement of the bow. As a consequence, in modelling a rubbed string instrument, for example, the present invention can impart a tonal fluctuation, due to the surface roughness of the bow and string, to the signal generated by the loop section.

The principle of the present invention may be embodied not only as a device invention as set forth above but also as a method or system invention. Further, the present invention may be implemented as a software program for execution by a computer, CPU (Central Processing Unit), DSP (Digital Signal Processor), etc. —which will be collectively called a "processor". Also, the present invention may be implemented as a recording medium storing such a program.

BRIEF DESCRIPTION OF THE DRAWINGS

For better understanding of the object and other features of the present invention, its preferred embodiments will be described in greater detail hereinbelow with reference to the accompanying drawings, in which:

FIG. 2 is a diagram explanatory of a modification of an interference section in the tone synthesizing device shown in FIG. 1;

FIGS. 3A to 1C are diagrams explanatory of a detailed structural example of an arithmetic operator shown in FIG. 1;

FIG. 4 is a block diagram showing a detailed inner organization of a nonlinear conversion section of FIG. 1;

DETAILED DESCRIPTION OF THE PREFERRED EMBODIMENTS

Figure 1:
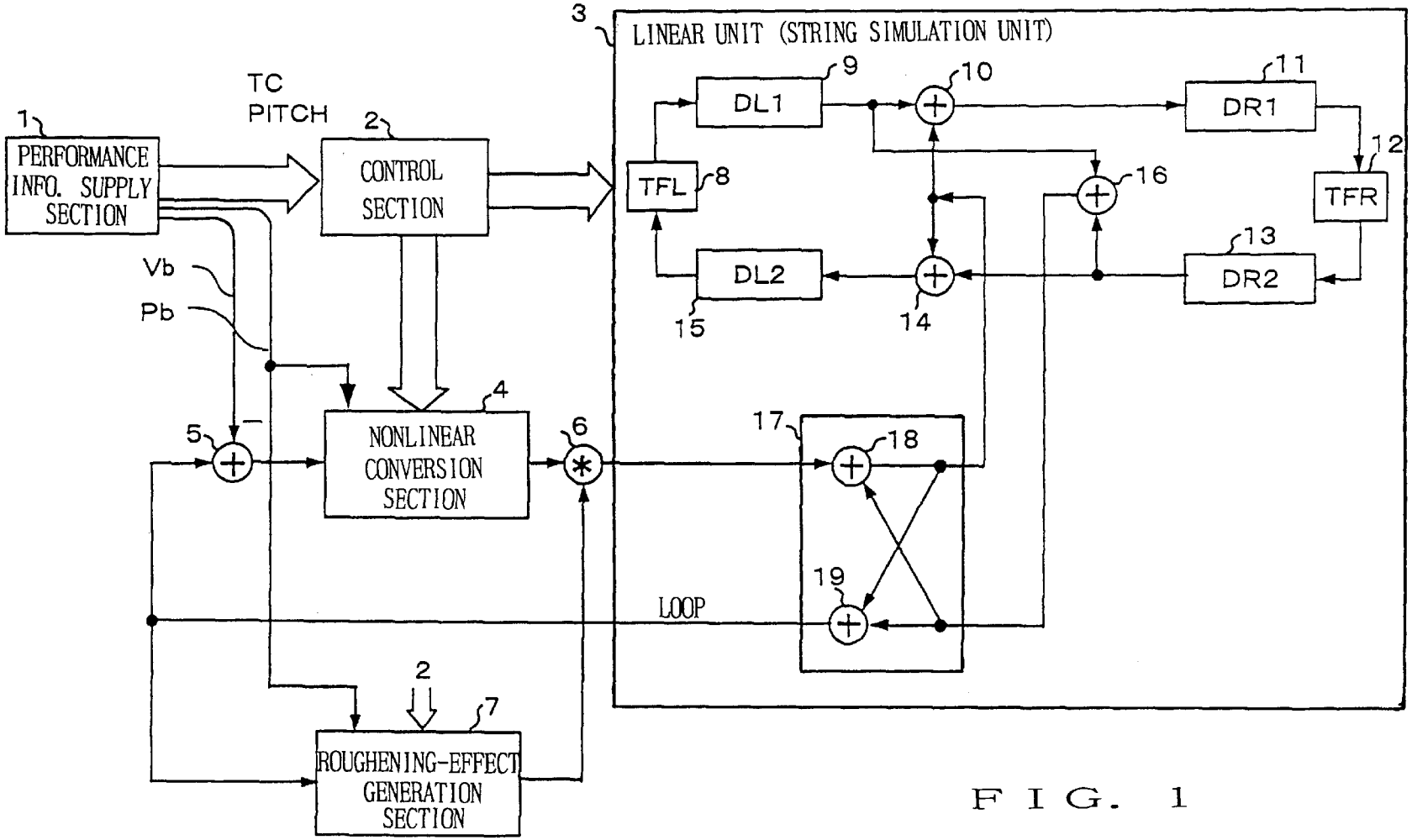
FIG. 1 is a block diagram showing a general hardware setup of a tone synthesizing device in accordance with a preferred embodiment of the present invention.
Figure 13A:
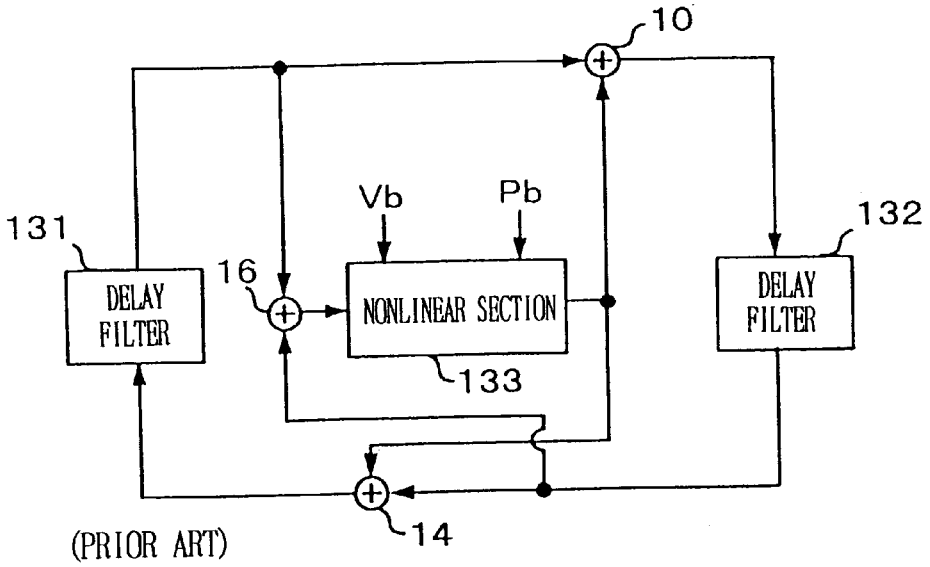
FIG. 13A is a block diagram showing a general organization of a conventional tone synthesizing device modelling a rubbed string instrument.
Figure 13B:
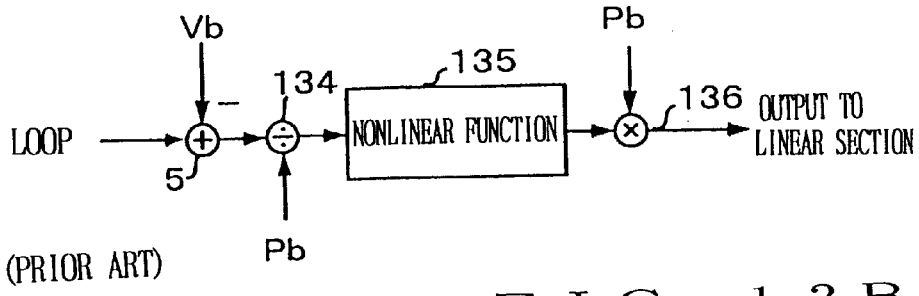
FIG. 13B is a block diagram showing an inner construction of a nonlinear section in the conventional tone synthesizing device of FIG. 13.

FIG. 1 is a block diagram showing a tone synthesizing device in accordance with a preferred embodiment of the present invention. Here, elements similar in function to those of FIGS. 13A and 13B are denoted by the same reference numerals as in FIGS. 13A and 13B and will not be described in detail to avoid unnecessary duplication. In FIG. 1, reference numeral 1 represents a performance information supply section, 2 a control section, 3 a linear unit, 4 a nonlinear conversion section, 5 an adder, 6 an arithmetic operator, 7 a roughening-effect signal generation section, 8 a left end filter 8, 9, 11, 13 and 15 are signal delay elements, 12 a right end filter, 17 an interference section, and 18 and 19 adders.

According to the present embodiment, the tone synthesizing device includes a loop section formed at least by the signal delay elements 9, 11, 13 and 15, and a driving signal generation unit that generates a driving signal by modifying a loop output signal LOOP, extracted from the loop section, in accordance with a difference between the loop output signal LOOP and a performance parameter such as a bowing velocity Vb and supplies the thus-generated driving signal back to the loop section. The driving signal generation unit includes the nonlinear conversion section 4 that converts an input signal, corresponding to the difference between the loop output signal LOOP and the performance parameter such as the bowing velocity Vb, into one of an input-output characteristic corresponding to small input signal levels (i.e., first input-output characteristic) or input-output characteristic corresponding to great input signal levels (i.e., second input-output characteristic) depending on the intensity of a signal based on the input signal. The nonlinear conversion section 4 also functions to restrain the input-output characteristic period, in which the input-output characteristic corresponding to small input signal levels shifts to the input-output characteristic corresponding to great input signal levels, from becoming shorter than the pitch period of the loop output signal LOOP.

Figure 14:
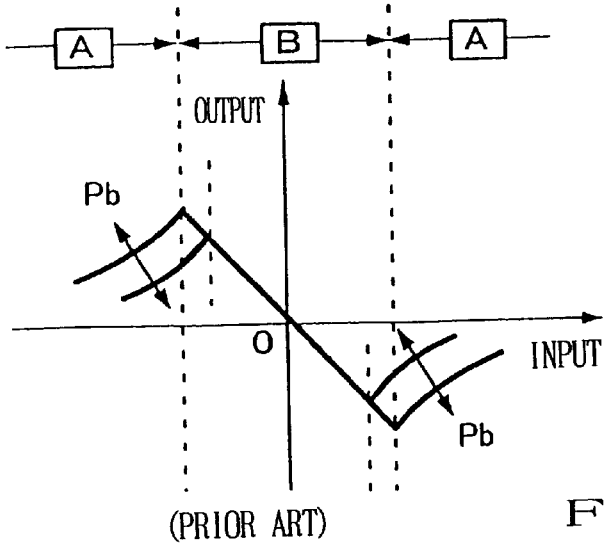
FIG. 14 is a graph explanatory of an input-output characteristic of a nonlinear function section shown in FIGS. 13A and 13B.

In the tone generating mechanism of the conventional rubbed string instrument as shown in FIG. 14, the input-output characteristic corresponding to small input signal levels is the stationary frictional characteristic where the intensity (absolute value) of the output signal increases in accordance with the intensity (absolute value) of the input signal as in the input range B. The input-output characteristic corresponding to great input signal levels, on the other hand, is the dynamic frictional characteristic where the intensity (absolute value) of the output signal decreases in accordance with the intensity (absolute value) of the input signal as in the input range A.

The roughening-effect signal generation section 7 generates a fluctuating signal having a frequency component corresponding to the intensity of the loop output signal LOOP. The fluctuating signal thus generated by the roughening-effect signal generation section 7 is passed to the arithmetic operator 6, which arithmetically operates the fluctuating signal with the performance parameter such as a bowing pressure Pb and then supplies the fluctuating signal to the loop section.

Of a tone color TC, tone pitch PITCH, bowing velocity Vb, bowing pressure Pb, etc. entered via a keyboard, predetermined input operators etc., the performance information supply section 1 supplies the tone color TC, tone pitch PITCH etc. to the control section 2 and supplies the bowing velocity Vb, bowing pressure Pb etc. to the nonlinear conversion section 4 and roughening-effect signal generation section 7. The control section 2, in turn, supplies the linear unit 3 and nonlinear conversion section 4 with control parameters that are based on the tone color TC and tone pitch PITCH and also supplies the roughening-effect signal generation section 7 with control parameters that are based on the tone color TC.

In the linear unit 3 functioning to simulate the string of the rubbed string instrument, a series connection of the signal delay element 11, right end filter 12 and signal delay element 13 corresponds to the delay filter 132 of Fi. 13, and a series connection of the signal delay element 15, left end filter 8 and signal delay element 15 corresponds to the delay filter 131 of FIG. 13. In principle, delay amounts DR1 and DR2 of the signal delay elements 11 and 13 are equal to each other, and similarly delay amounts DL1 and DL2 of the signal delay elements 15 and 9 are equal to each other. Distribution between the delay amounts DL1 +DL2 and the delay amounts DR1+DR2 is associated with a driven point of the string. Characteristics of the left end and right end filters TFL and TFR depend on signal attenuation, phase inversion by reflection, phase variation, etc. at a supported point of the string that is the vibrating body of the rubbed string instrument.

The interference section 17 is provided between the linear unit 3 and the later-described driving signal generation unit, although the interference section 17 is not necessarily essential to the present invention. The adder 19 in this interference section 17 adds together the outputs from the adders 16 and 18 of the linear unit 3 to generate the loop output signal LOOP and supply this loop output signal LOOP to the nonlinear conversion section 4, adder 5 and roughening-effect signal generation section 7 of the driving signal generation unit. The adder 18 adds together the output from the arithmetic operator 6 of the driving signal generation unit and the output from the adder 16 of the linear unit 3 and supplies the added result or sum to the adders 10 and 14 of the linear unit 3. In the case where no such interference section 17 is provided, the output from the adder 16 of the linear unit 3 is given directly to the driving signal generation unit as the loop output signal LOOP, and the output from the driving signal generation unit is given directly to the adders 10 and 14 of the linear unit 3.

In the driving signal generation unit, the nonlinear conversion section 4 corresponds to the nonlinear section 133 of FIGS. 13A and 13B. The adder 5 outputs an intensity level of the loop output signal LOOP, supplied from the linear unit 3, relative to the bowing velocity Vb (as represented by a mathematical expression of "LOOP−Vb"). The nonlinear conversion section 4 not only modifies such an output from the adder 5 in accordance with the bowing pressure Pb but also controls its modification characteristic in accordance with the input signal. The roughening-effect signal generation section 7 receives the loop output signal LOOP from the linear unit 3 to generate a fluctuating signal corresponding to the loop output signal LOOP. Then, the arithmetic operator 6 performs an arithmetic operation between the fluctuating signal and the output from the nonlinear conversion section 4, to thereby impart a feel of roughness to a synthesized tone.

FIG. 2 is a diagram explanatory of a modification of the interference section 17 shown in FIG. 1. Input-output characteristic of the modified interference section 17 is equivalent to that of the interference section 17 shown in FIG. 1. In FIG. 2, reference numerals 21 and 23 represent adders, and 22 a multiplier. Output from the adder 16 of the linear unit is multiplied by two by means of the multiplier 22, and the multiplied result or product is given to the adders 23 and 21. The adder 23 adds together the multiplied result and the output from the driving signal generation unit, so that the added result from the adder 23 is fed to the driving signal generation unit. Then, the output from the driving signal generation unit is added, via the adder 21, to the output from the adder 16 of the linear unit, and the added result from the adder 21 is then fed to the adders 10 and 14 of the linear unit.

FIGS. 3A to 3C are diagrams explanatory of details of the arithmetic operator 6 shown in FIG. 1. In the illustrated example of FIG. 3A, an adder 31 adds together the output from the nonlinear conversion section 4 and the output from the roughening-effect signal generation section 7 and passes the added result to the linear section 3. In the illustrated example of FIG. 3B, a multiplier 32 is employed in place of the adder 31 of FIG. 3A. Further, in the illustrated example of FIG. 3C, the multiplier 32 multiplies the output from the nonlinear conversion section 4 and the output from the roughening-effect signal generation section 7 and passes the multiplied result to the adder 31. The adder 31, in turn, adds the multiplied result to the output from the nonlinear conversion section 4 and gives the added result to the linear unit 3. The arithmetic operator 6 is not limited to the above-mentioned detailed examples and may be designed to perform various other arithmetic operations on the outputs from the nonlinear conversion section 4 and the roughening-effect signal generation section 7.

FIG. 4 is a block diagram showing a detailed inner organization of the nonlinear conversion section 4 of FIG. 1 along with the adder 5. In this figure, reference numeral 41 represents a first conversion characteristic table, 42 a second conversion characteristic table, 43 a signal processing section, 44 a coefficient generation section, 45 a switching section, 46, 47, 49 and 51 multipliers, and 48, 50 and 52 adders. The bowing pressure Vb is subtracted from the loop output signal LOOP by means of the adder 5, and the thus-calculated relative velocity is fed to the first and second conversion characteristic tables 41 and 42. Adder 50 is provided for use in a modification as will be described later.

The first conversion characteristic table 41 is one for providing a conversion characteristic when the string is driven with a dynamic frictional coefficient in the input range A shown in FIG. 14, and the second conversion characteristic table 42 is one for providing a conversion characteristic when the string is driven with a stationary frictional coefficient in the input range B shown in FIG. 14. Output from each of the first and second conversion characteristic tables 41 and 42 is sent to the corresponding multiplier 46 or 47 for multiplication by a weighting coefficient supplied from the coefficient generation section 44. The outputs from the first and second conversion characteristic tables 41 and 42, having been thus weighted, are then added together via the adder 48 and provided, as the output from the nonlinear conversion section 4 of FIG. 1, to the arithmetic operator 6. Therefore, strictly speaking, the illustrated example of FIG. 4 provides conversion characteristics in the input ranges A and B by multiplying the characteristics of the first and second conversion characteristic tables 41 and 42 by respective weighting coefficients supplied from the coefficient generation section 44.

The switching section 45 and coefficient generation section 44 use the output from the adder 5 as input signals thereto. These switching section 45 and coefficient generation section 44 function to switch between the outputs from the first and second conversion characteristic tables 41 and 42 in accordance with a control output from the signal processing section 43; to smooth a conversion characteristic transition in the embodiment, the weighting of the conversion characteristics is carried out before and after the switching. The adder 52 is provided for use in the modification as will be described later. As shown, the coefficient generation section 44 generates the weighting coefficients for the first and second conversion characteristic tables 41 and 42 in such a manner that their variation curves cross each other at a predetermined switching threshold value. With the input levels smaller than the switching threshold value, the weighting coefficients for the second conversion characteristic table 42 are greater than those for the first conversion characteristic table 41, while with the input levels greater than the switching threshold value, the weighting coefficients for the second conversion characteristic table 42 are smaller than those for the first conversion characteristic table 41. It is desirable that the switching between the outputs from the first and second conversion characteristic tables 41 and 42 be also controlled in accordance with the intensity of the bowing pressure Pb, although description of such control is omitted here for purposes of simplicity. For simplified control, the switching threshold value employed in the coefficient generation section 44 may, for example, be modified in accordance with the intensity of the bowing pressure Pb.

Further, in the illustrated example of FIG. 4, the first conversion characteristic table 41 provides the conversion characteristics such that the negative output signal decrease in its increasing rate to approach a given negative level as the input signal increases in level in a positive direction and that the positive output signal decrease in its decreasing rate to approach a given positive level as the input signal decreases in level in a negative direction. The first conversion characteristic table 41, on the other hand, is arranged to provide a given small negative level when the input signal is within the positive range, but provide a given small positive level when the input signal is within the negative range. The above-mentioned characteristic of approaching the given positive or negative level may be achieved by a weighting characteristic curve of the coefficient generation section 44.

Figure 5:
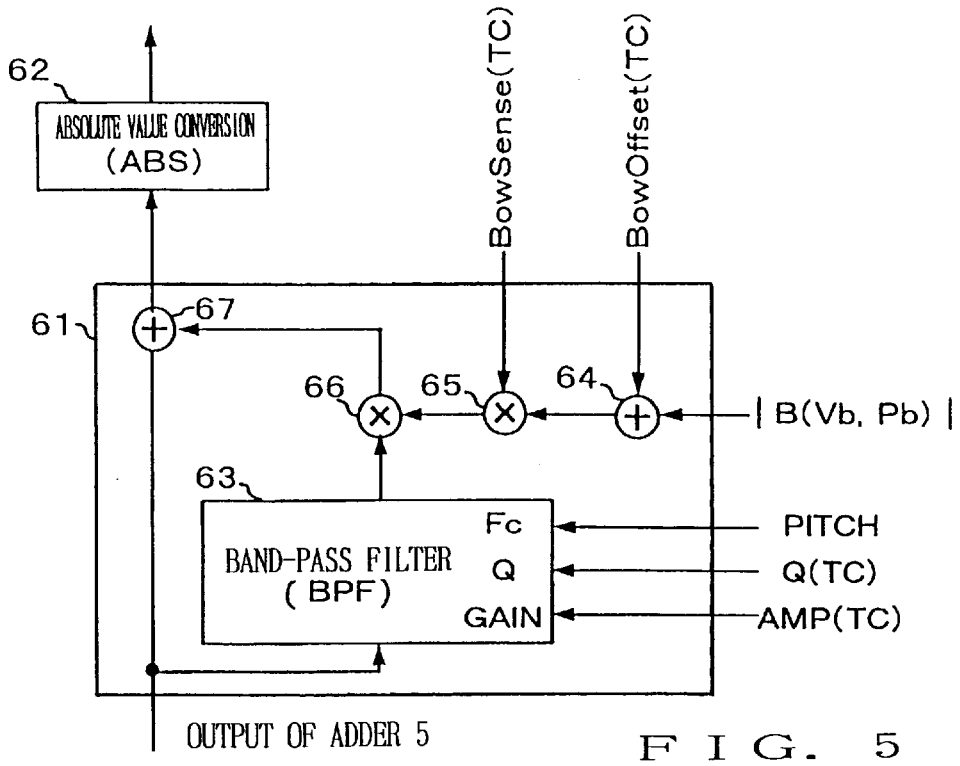
FIG. 5 is a block diagram showing a first detailed example of the structure of a signal processing section of FIG. 4.

FIG. 5 is a block diagram showing a first detailed example of the structure of the signal processing section 43 of FIG. 4. In this figure, reference numeral 61 a filter section, 62 an absolute value conversion section, 63 a band-pass filter, 64 and 67 adders, and 65 and 66 multipliers. The band-pass filter 63 in this signal processing section 43 passes therethrough a frequency component equal to the pitch period of the output signal from the adder 5 (i.e., the frequency in the fundamental vibration mode), but suppresses vibratory components (harmonic components) higher order than the fundamental pitch. The signal having been passed through the band-pass filter 63 is given to the coefficient generation section 44.

Figure 6:
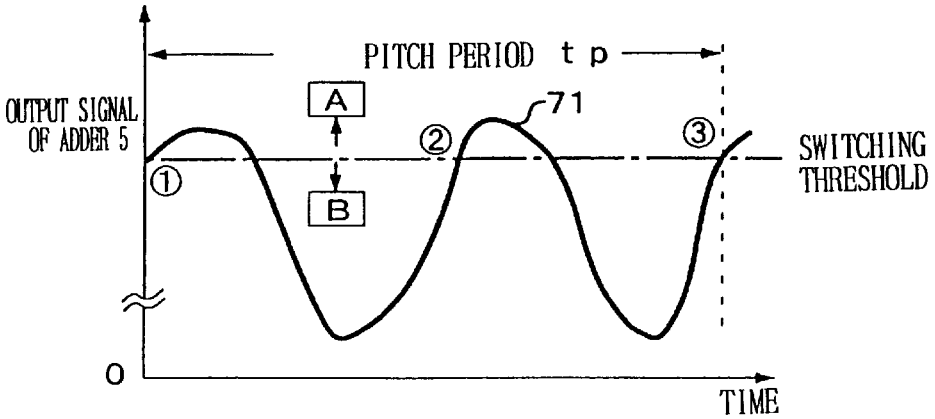
FIG. 6 is a waveform diagram explanatory of exemplary operation of the arrangements shown in FIGS. 1, 4 and 5.

FIG. 6 is a waveform diagram explanatory of exemplary operation of the arrangements shown in FIGS. 1, 4 and 5. In this figure, reference numeral 71 represents a variation in the output signal from the adder 5 when the loop output signal LOOP is in a "double-pitch vibration mode" where its frequency is twice as high as the fundamental pitch, i.e., its period is half the pitch period tp. The input level at which the input range B shifts to the input range A will hereinafter be called an "input threshold value". Once the physical model tone generator is brought to a high-order vibration mode, a time point when the output signal from the adder 5 exceeds the input threshold value would constantly occur a plurality of times (as denoted at points ①, ② and ③), within each pitch period, in response to the order of the vibration, or the frequency of occurrence of such time points would significantly increase. This is the reason why the output signal from the adder 5 is fed to the coefficient generation section 44 after being passed through the band-pass filter 63.

According to the first example, a control signal is generated on the basis of the output signal from the adder 5 having passed through the band-pass filter 63, and the input-output characteristic of the coefficient generation section 44 is varied, on the basis of a result of a comparison made between the thus-generated control signal and the switching threshold value, so as to prevent the shift to the high-order vibration mode.

Figure 7:
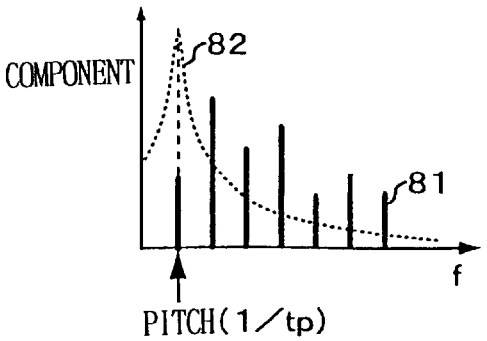
FIG. 7 is a diagram showing an exemplary frequency characteristic of a band-pass filter of FIG. 4.

FIG. 7 is a diagram showing an exemplary frequency characteristic of the band-pass filter 63 of FIG. 4. In this figure, reference numeral 81 represents a frequency spectrum of the output signal from the adder 5, and 82 represents the frequency characteristic of the band-pass filter 63. In this illustrated example, the band-pass filter 63 has its peak at the pitch frequency (fundamental frequency). The pitch frequency component is emphasized by passing the output signal from the adder 5 through the band-pass filter 63 having such a characteristic, so that the switching section 45 switches the conversion characteristic in response to the signal whose second- and higher-order frequency components, i.e., components higher than the fundamental pitch as shown in FIG. 6, have been attenuated.

In this way, time point ②, one of the time points when the input range B shifts to the input range A, disappears so that the arithmetic operator 6 is supplied with a driving signal in which the original time interval between time point ① and time point② extended to an interval between time ① and time point ③. As a consequence, even when the loop output signal LOOP has a frequency twice as high as the fundamental pitch and hence the output from the adder 5 has a frequency twice as high as the fundamental pitch, the driving is effected with the pitch period, so that the loop output signal LOOP is modified to be stabilized at the pitch period. Also, the shift from the fundamental frequency mode to the high-order vibration mode is effectively suppressed.

Referring back to FIG. 5, the characteristic of the band-pass filter 63 in the filter section 6 is varied not only in accordance with the pitch PITCH of the loop output signal LOOP given via the control section 2 as performance information, but also in accordance with an amplitude level AMP(TC) and a "Q" or sharpness of resonance Q(TC) set for each individual tone color TC. Where a digital filter is used as the band-pass filter 63, filtering arithmetic operations are carried out using a filtering coefficient determined on the basis of these values.

Further, the adder 64 adds an offset value BowOffset(TC) to an absolute value of a function B(Vb, Pb) of the bowing velocity Vb and bowing pressure Pb. The addition result or sum from the adder 64 is sent to the multiplier 65 for multiplication by a sensitivity value BowSense(TC). The multiplication result from the multiplier 65 is then multiplied, via the multiplier 66, by the output from the band-pass filter 63. Further, the adder 67 adds the multiplication result from the multiplier 66 to the output signal from the adder 5, and the output from the adder 67 is fed to the absolute value conversion section (ABS) 62. Then, the output from the absolute value conversion section (ABS) 62 is sent to the coefficient generation section 44 of FIG. 4. The offset value BowOffset(TC) and sensitivity value BowSense (TC) are also set for each individual tone color TC. Where the coefficient generation section 44 is designed to output a coefficient in response to each of positive and negative input signals, the absolute value conversion section (ABS) 62 may of course be omitted.

Note that the above-described arrangement for providing the sum of the signal corresponding to the output from the band-pass filter 63 and the loop output signal LOOP may be replaced by a filter having a characteristic equivalent to that of the described arrangement. Further, as the input signal to the band-pass filter 63, there may be employed a signal from a particular one of the above-described components or a combination thereof, such as a signal corresponding to the sum between the output signal from the adder 5 of FIG. 4 and the output signal from the adder 48 that is provided as an ultimate output signal from the nonlinear conversion section.

Figure 8:
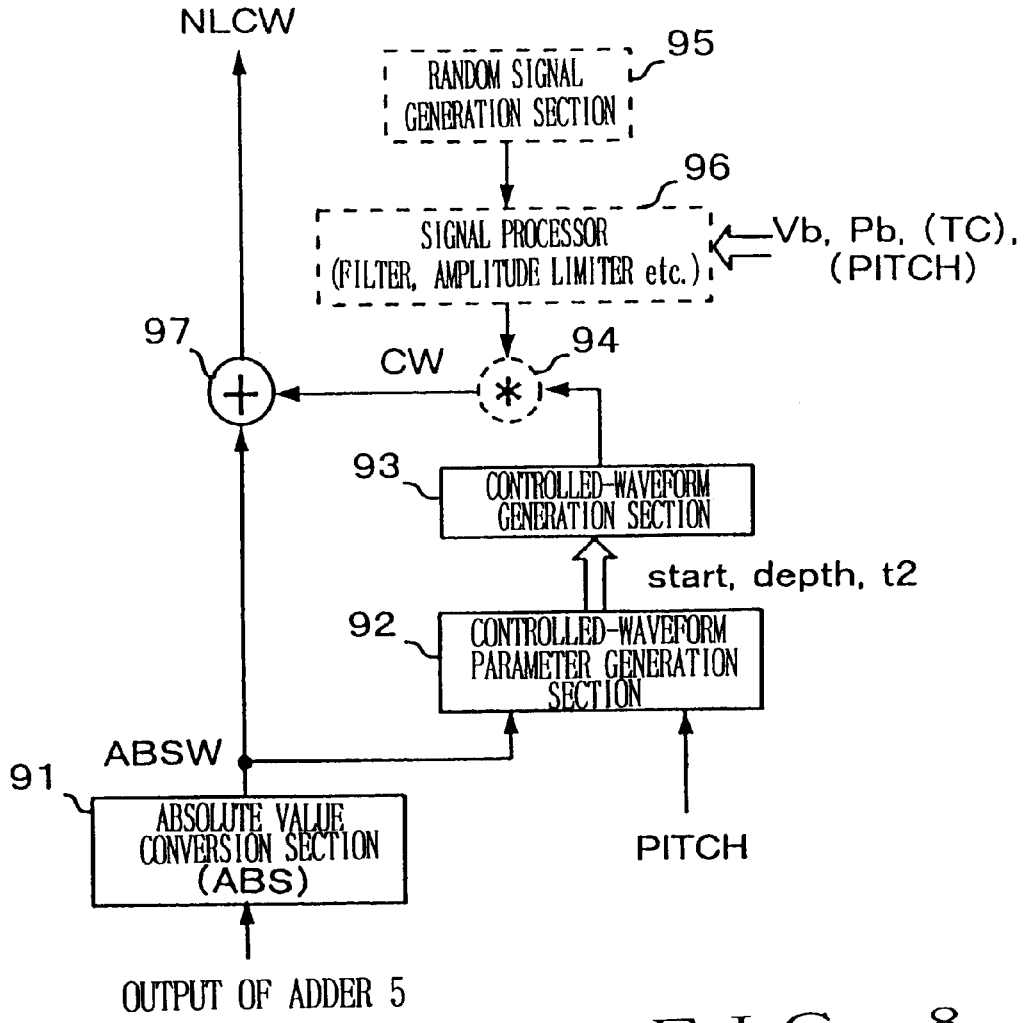
FIG. 8 is a block diagram showing a second detailed example of the structure of the signal processing section of FIG. 4.

FIG. 8 is a block diagram showing a second detailed example of the structure of the signal processing section 43 of FIG. 4. In this figure, reference numeral 91 represents an absolute value conversion section, 92 a controlled-waveform parameter generation section, 93 a controlled-waveform generation section, 94 an arithmetic operator, 95 a random signal generation section, and 96 a signal processor.

Figure 9A:
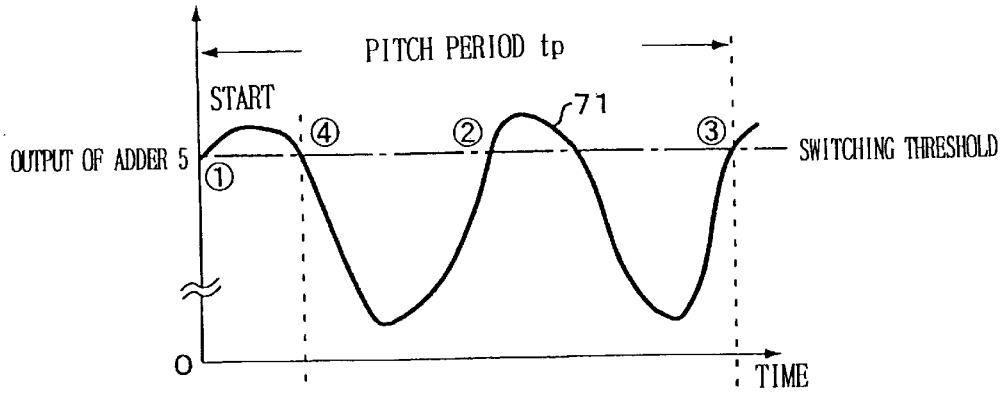
FIGS. 9A to 9C are waveform diagrams explanatory of exemplary operation of the second detailed structural example of the signal processing section shown in FIG. 8.
Figure 9B:
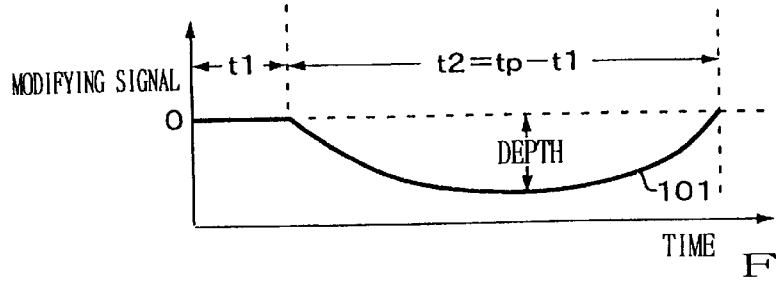
Figure 9C:
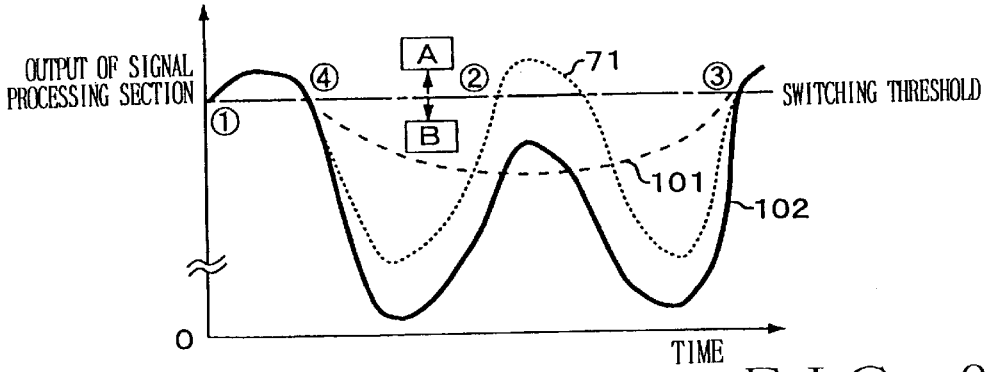

FIGS. 9A to 9C are waveform diagrams explanatory of exemplary operation of the second example of the signal processing section 43 shown in FIG. 8; more specifically, FIG. 9A shows a waveform of the output signal from the adder 5, FIG. 9B shows a waveform of a modifying signal, and FIG. 9C shows a waveform of the output signal from the signal processing section 43.

According to the second structural example of FIG. 8, a control signal is generated on the basis of the output signal from the adder 5, and the input-output characteristic of the coefficient generation section 44 is varied on the basis of a result of a comparison made between the thus-generated control signal and the switching threshold value, and the control parameter generation section 92 detects when the level of the control signal exceeds the switching threshold value. To restrain the control signal level from exceeding the switching threshold value within the pitch period tp immediately following the detection, the control signal level is adjusted, via the above-mentioned controlled-waveform generation section 93, adder 97, etc., to follow a predetermined variation characteristic, so that a shift to the high-order vibration mode can be prevented.

Further, by generating the modifying signal CW101 to push the waveform of the output signal from the adder 5 in the "double-pitch vibration mode", where the frequency of the loop output signal LOOP is twice as high as the fundamental pitch, i.e., its period is half the pitch period tp, into the range B, this example restrains the shift from the second conversion characteristic table 42 to the first conversion characteristic table 41 from taking place at a rate twice as high as the fundamental pitch or over.

The output signal 71 from the adder 5 when the loop output signal LOOP is in the "double-pitch vibration mode" is given to the absolute value conversion section (ABS) 91 of FIG. 8, and the output signal 71 converted by the conversion section (ABS) 91 into an absolute value is then passed to the controlled waveform parameter generation section 92. As shown in FIGS. 9A and 9B, detection is made of a START time point ① when the output signal 71 from the adder 5 has exceeded the switching threshold value and another time point ④ when the output signal 71 has dropped below the switching threshold value, to thereby determine a time length t1 between time points ① and ④. In addition, another time length t2 is determined by subtracting the time length t1 from the pitch period tp of the loop output signal LOOP. The pitch period tp of the loop output signal LOOP is determined on the basis of pitch information PITCH obtained from the performance information supply section 1 of FIG. 1 by way of the control section 2. Further, the varying absolute value of the output signal 71 from the adder 5 is constantly monitored so that a waveform variation depth DEPTH is set on the basis of an amplitude variation range of the monitored absolute values. Alternatively, the waveform variation depth DEPTH may be set as a fixed value.

The controlled-waveform generation section 93, which has basic variation characteristics prestored in a numerical value table, generates a negative modifying signal CW101 of a downward convex shape which has a time length or width t2 and amplitude DEPTH corresponding to the above-mentioned START point, time length t2 and depth DEPTH. In an alternative, the numerical value table may be omitted, and arithmetic operations may be performed to realize the same variation characteristics as provided by the table. The negative modifying signal CW101 generated by the controlled-waveform generation section 93 is added, via the adder 97, to the absolute value of the output signal from the adder 5 in the double-pitch vibration mode, and the addition result output from the adder 97 becomes an output signal NLCW102 from the signal processing section as shown in FIG. 9C. The output signal NLCW102 from the signal processing section is sent to the coefficient generation section 44 of FIG. 4, in response to which the coefficient generation section 44 switches between the first and second conversion characteristic tables 41 and 42 as noted above.

The modifying signal shown in FIG. 9B is set to a variation characteristic with a view to restraining the occurrence of time point ② in the output signal from the adder 5 in the double-pitch vibration mode. The waveform of the modifying signal may be set according to the order of the vibration mode that is to be suppressed.

As apparent from FIG. 9C, the signal NLCW102 output from the signal processing section hardly exceeds the switching threshold value within the time length t2 covering from time point ④ to time point ③, so that time point ② present in the waveform of FIG. 9A disappears. As a consequence, the output signal can be prevented from exceeding the switching threshold value more than twice within a single pitch period tp.

As shown in FIG. 8, a random signal output from the random signal generation section 95 may be processed by the signal processor 96 in accordance with a signal corresponding to the bowing velocity Vb, bowing pressure Vp, tone color TC and pitch PITCH. Then, similarly to the arithmetic operator 6 of FIG. 3, the arithmetic operator 94 may perform arithmetic operations, such as addition and multiplication, between the output signal from the processor 96 and the output from the controlled-waveform generation section 93 so that the output from the operator 94 is given to the adder 97. By thus varying the degree of the restraint of the high-order vibration mode in accordance with the tone color, it is possible to perform control suitable for the tone color. Further, the too-regular or too-periodic restraint can be avoided by applying the random signal, which could effectively minimize undesirable unnaturalness.

Furthermore, as the input signal to the control parameter generation section 92, there may be employed a signal from a particular one of the above-described components or a combination thereof, such as an absolute value of a signal corresponding to the sum between the output signal from the adder 5 of FIG. 4 and the output signal from the adder 48 that is provided as the ultimate output signal from the nonlinear conversion section.

Figure 10:
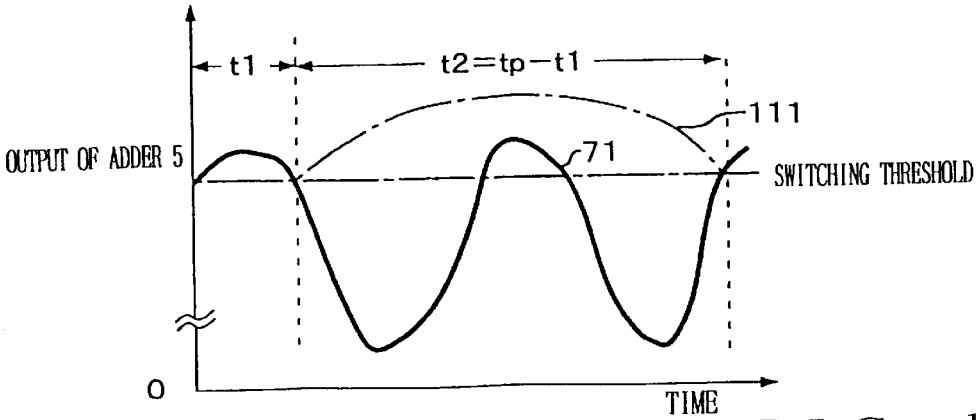
FIG. 10 is a waveform diagrams explanatory of exemplary opera on of a third detailed example of the signal processing section of FIG. 4.

FIG. 10 is a waveform diagrams explanatory of exemplary operation of a third detailed example of the signal processing section 43 of FIG. 4, where reference numeral 111 represents the switching threshold value. According to the third example of FIG. 10, the switching threshold value 111, rather than the control signal, is controlled to follow a predetermined variation characteristic, in order to restrain the control signal, corresponding to the output signal from the adder 5, from exceeding the switching threshold value in the pitch period tp immediately following the detection of the control signal having exceeded the switching threshold value.

With this arrangement, the shift from the second conversion characteristic table 42 to the first conversion characteristic table 41 is prevented from occurring at a rate twice as high as the fundamental pitch or, so that the shift to the high-order vibration mode can be effectively avoided. Although not specifically described here, the switching threshold value is created in the same way as the modifying signal as described earlier in relation to FIGS. 8 and 9.

Furthermore, according to an unillustrated fourth example of the signal processing section 43 of FIG. 4, a control signal is generated on the basis of the output signal from the adder 5, and the input-output characteristic of the coefficient generation section 44 is varied on the basis of a result of a comparison made between the thus-generated control signal and the switching threshold value. In this example, the input-output characteristic of the coefficient generation section 44 may be left unchanged even when the switching threshold value has exceeded the switching threshold value more than once within a time period corresponding to the pitch period of the loop output signal LOOP. The switching points may be thinned out logically in such a manner that the shift from the second conversion characteristic table 42 to the first conversion characteristic table 41 occurs only once within a single pitch period tp of the loop output signal LOOP. However, the synthesized tone will assume some unwanted unnaturalness if the thinning-out is effected in an excessively regular fashion.

Further, in the arrangement of FIG. 4, the output from the nonlinear conversion section may be multiplied by a value FEEDBACK(TC) via the multiplier 49 and added to output from the adder 5 via the adder 50 and the resultant added value or sum from the adder 50 is fed to the first and second version characteristics 41 and 42. In this way, it is possible to generate a nonlinearly converted output with certain hysteresis. Positive feedback amount can be controlled by setting the above-mentioned value FEEDBACK(TC) according to the tone color TC. By so doing, the output from the nonlinear conversion section and its variation can be caused to differ between a time when the output from the adder 5 increases in level and another time when the output from the adder 5 decreases in level. In another alternative, the coefficient output from the coefficient generation section 44 to the multiplier 46 may be multiplied via the multiplier 51 by the FEEDBACK(TC) value, and the multiplied result or product from the multiplier 51 may be added, via the adder 52, to the output from the signal processing section 43 and fed back to the coefficient generation section 44.

Whereas the arrangement of FIG. 4 has been described as providing the output signal from the adder 5, representing a relative velocity between the bowing velocity Vb and the loop output signal LOOP, to the signal processing section 43, the loop output signal LOOP may be given directly to the signal processing section 43. The control conditions would differ temporarily depending on which of the relative-velocity-representing output signal from the adder 5 and the loop output signal LOOP is used; however, the control conditions would not greatly differ in the long run irrespective of which of the relative-speed-representing output signal and the loop output signal LOOP is used, because the output value from the nonlinear conversion sectional, after all, is determined through interaction between these signals.

Figure 11:
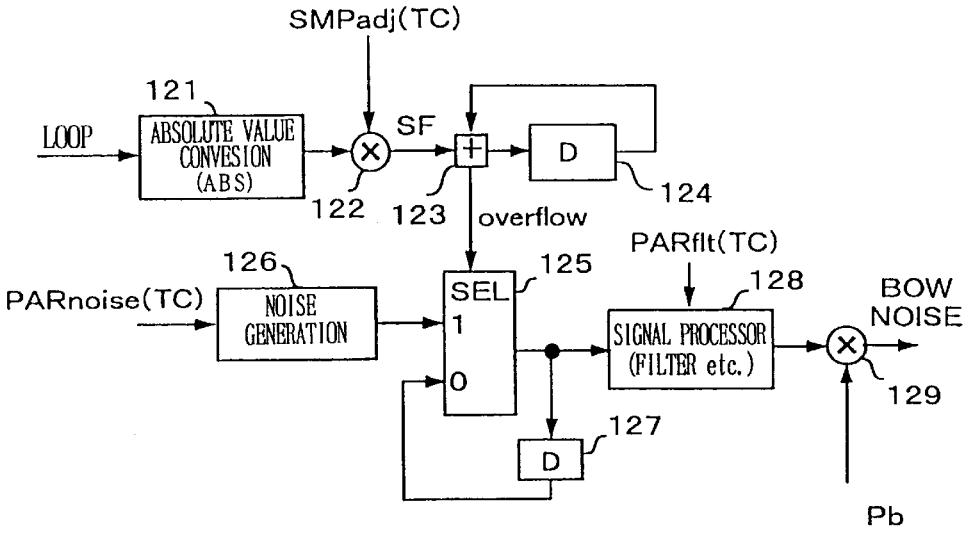
FIG. 11 is a block diagram showing a first detailed example of the structure of a roughening-effect signal generation section shown in FIG. 1.

FIG. 11 is a block diagram showing a first detailed example of the structure of the roughening-effect signal generation section 7 shown in FIG. 1. In this figure, reference numeral 121 represents an absolute value conversion section, 122 a multiplier, 123 an adder, 124 a signal delay element, 125 a selector, 126 a noise generation section, 127 a signal delay element, 128 a signal processor, and 129 a multiplier 129.

Figure 12A:
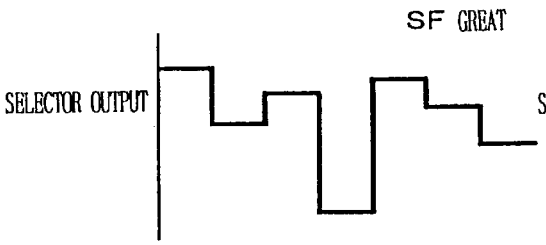
FIGS. 12A and 12B are waveform diagrams explanatory of variations in an output from a selector of FIG. 11.
Figure 12B:
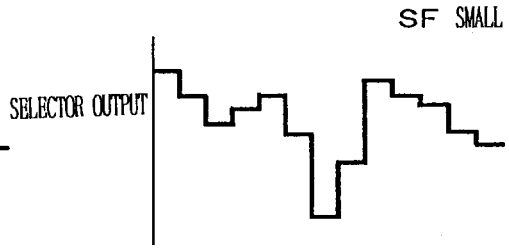

FIGS. 12A and 12B are waveform diagrams explanatory of variations in the output from the selector 125 of FIG. 11; specifically, these two figures illustrate a difference between the variations due to intensity of a signal SF proportional to the intensity of the input signal.

The roughening-effect signal generation section 7 in the example of FIG. 11 functions to generate a fluctuating signal having a frequency component corresponding to the intensity of the loop output signal LOOP. To this end, the multiplier 129 of the roughening-effect signal generation section 7 modulates a performance parameter, such as the bowing pressure Pb, and supplies the thus-modulated performance parameter to the linear unit 3 by way of the arithmetic operator 6. The fluctuating signal is generated by sampling and holding the random signal from the noise generation section 126 in a cycle corresponding to the intensity of the loop output signal LOOP.

The loop output signal LOOP is converted into an absolute value by means of the absolute value conversion section 121 and is then multiplied, via the multiplier 122, by a weighting coefficient SMPadj(TC) set in accordance with the tone color TC, to thereby provide the above-mentioned signal SF. This signal SF is added, via the adder 123, to the last or preceding added value delayed by one sample via the delay element 124. Thus, the adder 123, which thus provides an accumulatively added value, outputs an overflow signal Overflow once the accumulated value exceeds a predetermined value. This overflow signal Overflow is provided as a control input to the selector 125. The noise generation section 126, generating noise in binary representation or multi-bit digital representation, is set to a random signal characteristic in accordance with a parameter PARnoise(TC) corresponding to the tone color TC, so as to supply a signal of a random amplitude to a first input terminal of the selector 125.

The noise generation section 126 may comprise a ROM (Read-Only Memory) or an M-type random signal generator; alternatively, an output from the noise-signal generating element may be subjected to analog-to-digital conversion to provide such noise. The noise generation section 126 outputs random signals in response to predetermined clock pulses. To a second input terminal of the selector 125 is applied the preceding output from the selector 125 having been delayed by one sample via the delay element 127. In turn, the selector 125 samples and holds the output from the noise generation section 126 and outputs the random signal of the noise generation section 126 over a variation time length proportional to the intensity of the loop output signal LOOP. This random signal contains a frequency component corresponding to the sampling frequency employed and hence a frequency component corresponding to the intensity of the loop output signal LOOP.

The output signal from the selector 125 is sent to the signal processor 128 that is controlled by a filter parameter PARflt(TC) set according to the tone color, where it is subjected to a filtering process. It is preferable that the signal processor 128 comprise a high-pass filter that cuts off a D.C. component to emphasize a feel of roughness. The output from the signal processor 128, i.e., the fluctuating signal, is multiplied, via the multiplier 129, with the bowing pressure Pb, so that the bowing pressure Pb modulated with the fluctuating signal is provided as a roughening effect signal BOWNOISE. This roughening effect signal BOWNOISE, as shown in FIG. 1, is fed to the arithmetic processor 6 that supplies the linear unit 3 with a driving signal, so that a fluctuation is imparted to a signal circulating through the linear unit 3.

It will be appreciated that the multiplier 129 may be replaced with an adder that adds the bowing pressure Pb to the multiplied result or product between the bowing pressure Pb and the fluctuating signal. In another alternative, the multiplier 129 may be replaced with an adder that outputs a sum between the bowing pressure Pb and the fluctuating signal. Namely, the fluctuating signal may not only be used to modulate the bowing pressure Pb to fit a physical image but also be supplied to the linear unit 3 after having been arithmetically operated with the bowing pressure.

The output waveform of the noise generation section 126 models a surface pattern of the bow. The variation time length of the output waveform is varied according to the intensity of the loop output signal LOOP in such a manner that the variation becomes more greater as the string vibration velocity increases. In stead of using the loop output signal LOOP, the output from the adder 5 of FIG. 1, representing a velocity relative to the bowing velocity Vb, may be fed to the absolute value conversion section 121. In another alternative, various signals input to optionally-selected points in the linear unit 3 may be combined together to provide the input signal. Further, the roughening effect signal BOWNOISE may be introduced into the linear unit 3 via an input point other than the output point of the nonlinear conversion section 4.

In FIG. 11 and 12A and 12B, the surface pattern of the bow is modelled using the noise signal. Although not specifically described here, there may be used, as a second structural example of the roughening-effect signal generation section 7, a cyclic signal, such as a sinusoidal wave signal, whose period is controlled in accordance with the loop output signal LOOP. Further, as a third structural example of the roughening-effect signal generation section 7, variation patterns based on the condition of contact between the surfaces of the string and the bow may be prestored in a waveform memory so that the variation patterns stored in the waveform memory are read out at a readout frequency corresponding to the intensity of the loop output signal, bowing velocity Vp, bowing pressure Pb, etc. and the roughening effect signal BOWNOISE is generated on the basis of the data thus read out from the waveform memory. In this manner, a feel of roughness can be imparted to the tone by supplying the linear unit 3 with the signal modulated in a cycle corresponding to the vibrating condition, relative velocity between the bow and the string.

It will be appreciated that the above-mentioned fluctuating-signal generating arrangement is also applicable to generation of a fluctuating signal having a frequency component that does not depend on the intensity of the loop output signal LOOP. In this case, it is only necessary to fix the period in which the selector 125 samples and holds the output from the noise generation section 126.

The relative velocity between the string velocity and the bowing velocity Vb has been described above as being determined assuming that a signal corresponding to the velocity of the string's physical movement is used as the loop output signal LOOP of the linear unit 3. Alternatively, the loop output signal LOOP may be replaced by a variable representing any other form of vibration such as physical displacement of the string, and the arithmetic operations may be varied in accordance with the variable.

Further, the description has been made above in relation to the case where the pitch period tp based on pitch information PITCH set as performance information is used as the pitch period of the loop output signal LOOP. Alternatively, the pitch period of the loop output signal LOOP may be constantly monitored so that a short-term average of the monitored pitch periods may be used as the pitch period.

Furthermore, the above description has been made about the nonlinear conversion characteristic in modelling the tone generating mechanism of a rubbed string instrument. However, in a situation where the tone generating mechanism of any other musical instrument is modelled and if the input-output characteristic corresponding to great input signal levels differ from the input-output characteristic corresponding tor small input signal levels as shown in FIG. 14, the principle of the present invention can effectively restrain the high-order vibration mode in the same manner as described above.

Moreover, in the case where the tone generating mechanism of a musical instrument other than rubbed string instruments is modelled, an alternative arrangement may be made such that the adder 5 shown in FIGS. 1 and 4 provides the sum between the loop output signal LOOP from the linear unit 3 and the bowing velocity Vb and the nonlinear conversion is performed on the basis of the sum signal to provide a resultant driving signal to the linear unit 3.

Furthermore, although the above-described inventive arrangements may be implemented by hardware logic alone, they may be implemented by use of a DSP (Digital Signal Processor) capable of multiplications to carry out filtering operations. In such a case, it is possible to flexibly deal with structural changes in the tone synthesizing algorithm, changes in the parameters etc., by just changing a program for controlling the DSP. This control program is typically stored in a recording medium such as ROM or RAM.

Furthermore, the present invention may be implemented as a software tone generator program for execution by a personal computer provided with a ROM, RAM, D/A converter, etc. under the control of the operating system. The tone generator program may be supplied in a CD-ROM (Compact Disk-Read Only Memory) or flexible magnetic disk (FD) and then loaded onto a hard magnetic disk (HD) of a personal computer.

As has been so far described, the tone synthesizing device of the present invention is characterized in that, when the loop output signal starts vibrating in a second- or higher-order mode, against the will of a human player, during the course of tone generation, it performs control to restrain a shift from the stationary frictional state to the dynamic frictional state from occurring more than necessary within a desired pitch period. Thus, the present invention can advantageously prevent occurrence of such an unwanted shift to the high-order vibrating mode. As a result, even beginners without skill can readily perform in such a manner that the tone synthesizing device never generates an "out-of-tune" or "falsetto-like" tone which was a problem in the prior art. Particularly, in modelling a rubbed string instrument, the unwanted shift to the high-order vibrating mode van be prevented effectively by appropriately setting performance parameters corresponding to a bowing operation.

In addition, the tone synthesizing device of the present invention can give a generated tone fluctuations corresponding to the intensity of the loop output signal. Particularly, in modelling a rubbed string instrument, the present invention can faithfully simulate random fluctuations of a generated tone due to roughness in the surfaces of the bow and string of the rubbed string instrument.

What is claimed is:

1. A tone synthesizing device comprising:

a loop section including at least a signal delay element, a delay amount of said signal delay element being controlled in accordance with tone pitch designating information; and a driving signal generation unit that generates a driving signal by modifying a loop output signal from said loop section in accordance with a performance parameter and supplying the generated driving signal to said loop section, said driving signal generation unit including:

a nonlinear conversion section that performs a nonlinear conversion on an input signal corresponding to the loop output signal and the performance parameter, said nonlinear conversion section switching an input-output characteristic, to be used for converting the input signal, into one of at least first and second input-output characteristics in accordance with intensity of a signal based on the loop output signal or the input signal; and a control section that restrains a period in which the input-output characteristic to be used for converting the input signal shifts from said first input-output characteristic to said second input-output characteristic from becoming shorter than a pitch period corresponding to a tone pitch designated by the pitch designating information.

2. A tone synthesizing device as recited in claim 1 wherein said first input-output characteristic is a predetermined input-output characteristic corresponding to small input signal levels, and said second input-output characteristic is a predetermined input-output characteristic corresponding to great input signal levels.

3. A tone synthesizing device as recited in claim 1, wherein said nonlinear conversion section includes a determination section for determining the intensity of the signal based on the loop output signal or the input signal and switches the input-output characteristic, to be used for converting the input signal, into one of said at least first and second input-output characteristics in accordance with the intensity determined by said determination section, and wherein said control section includes a filter having a frequency amplitude characteristic adjusted according to said tone pitch designated by said pitch designating information and sends the signal based on the loop output signal or the input signal to said determination section after passing the signal through said filter.

4. A tone synthesizing device as recited in claim 1, wherein said control section performs control such that a shift from said first input-output characteristic to said second input-output characteristic does not take place more than once within a single period of said tone pitch designated by said pitch designating information.

5. A tone synthesizing device as recited in claim 4 wherein said nonlinear conversion section includes a determination section for determining the intensity of the signal based on the loop output signal or the input signal and switches the input-output characteristic, to be used for converting the input signal, into one of said at least first and second input-output characteristics in accordance with the intensity determined by said determination section, and wherein after the shift from said first input-output characteristic to said second input-output characteristic takes place once within the single period of the pitch of the tone, said control section, during a remaining time in said single period, controls a level of the signal based on the loop output signal or the input signal to be sent to said determination section, to thereby restrain the shift from said first input-output characteristic to said second input-output characteristic from taking place further.

6. A tone synthesizing device as recited in claim 4, wherein said nonlinear conversion section includes a determination section for determining the intensity of the signal based on the loop output signal or the input signal and switches the input-output characteristic, to be used for convert the input signal, into one of said at least first and second input-output characteristics in accordance with the intensity determined by said determination section, and wherein after the shift from said first input-output characteristic to said second input-output characteristic takes place once within the single period of said tone pitch designated by said pitch designating information, said control section, during a remaining time in said single period, controls a threshold level of said determination, to thereby restrain the shift from said first input-output characteristic to said second input-output characteristic from taking place further.

7. A tone synthesizing device as recited in claim 1 which further comprises a random controller that controls said control section in accordance with a random signal.

8. A tone synthesizing device as recited in claim 1 which further comprises a fluctuating-signal generation section that generates a fluctuating signal containing a frequency component corresponding to the loop output signal or corresponding to the loop output signal and the performance parameter and supplies the generated fluctuating signal to said loop section.

9. A tone synthesizing method comprising:

a loop formation step of forming a loop for circulating a signal therethrough and including at least a signal delay element, a delay amount of said signal delay element being controlled in accordance with tone pitch designating information; and a driving signal generation step of generating a driving signal by modifying a loop output signal from said loop in accordance with a performance parameter and supplying the generated driving signal to said loop, said driving signal generation step including:

a nonlinear conversion step of performing a nonlinear conversion on an input signal corresponding to the loop output signal and the performance parameter, said nonlinear conversion step switching an input-output characteristic, to be used for converting the input signal, into one of at least first and second input-output characteristics in accordance with intensity of a signal based on the loop output signal or the input signal; and a control step of restraining a period in which the input-output characteristic to be used for converting the input signal shifts from said first input-output characteristic to said second input-output characteristic from becoming shorter than a pitch period corresponding to a tone pitch designated by the pitch designating information.

10. A machine-readable recording medium containing a group of instructions of a program executable by a processor for synthesizing a tone, said program comprising the steps of:

forming a loop for circulating a signal therethrough and including at least a signal delay element, a delay amount of said signal delay element being controlled in accordance with tone pitch designating information; and generating a driving signal by modifying a loop output signal from said loop in accordance with a performance parameter and supplying the generated driving signal to said loop, said step of generating a driving signal including:

a nonlinear conversion step of performing a nonlinear conversion on an input signal corresponding to the loop output signal and the performance parameter, said nonlinear conversion step switching an input-output characteristic, to be used for converting the input signal, into one of at least first and second input-output characteristics in accordance with intensity of a signal based on the loop output signal or the input signal; and a control step of restraining a period in which the input-output characteristic to be used for converting the input signal shifts from said first input-output characteristic to said second input-output characteristic from becoming shorter than a pitch period corresponding to a tone pitch designated by the pitch designating information.

11. A tone synthesizing device comprising:

a loop section including at least a signal delay element;

a driving signal generation unit that generates a driving signal by modifying a loop output signal from said loop section in accordance with a performance parameter and supplies the generated driving signal to said loop section; and a fluctuating-signal generation section that generates a fluctuating signal containing a frequency component corresponding to the loop output signal or corresponding to the loop output signal and the performance parameter and supplies the generated fluctuating signal to said loop section, wherein a variation time length of the fluctuating signal varies in response to the loop output signal or the loop output signal and the performance parameter.

12. A tone synthesizing device as recited in claim 11 wherein said fluctuating-signal generation section performs an arithmetic operation between the generated fluctuating signal and a second performance parameter and supplies a result of the arithmetic operation to said loop section.

13. A tone synthesizing device as recited in claim 11 wherein said fluctuating-signal generation section generates the fluctuating signal containing a frequency component corresponding to intensity of the loop output signal or intensity of the loop output signal and the performance parameter.

14. A tone synthesizing device as recited in claim 11 wherein said fluctuating-signal generation section includes a noise signal generation section and generates the fluctuating signal containing the frequency component by sampling a noise signal, generated by said noise signal generation section, using a signal based on the loop output signal or based on the loop output signal and the performance parameter.

15. A tone synthesizing device as recited in claim 11 wherein said fluctuating-signal generation section includes a waveform signal generation section and generates the fluctuating signal containing the frequency component by modulating a period of a waveform signal, generated or to be generated by said waveform signal generation section, using a signal based on the loop output signal or based on the loop output signal and the performance parameter.

16. A tone synthesizing method comprising:

a loop formation step of forming a loop for circulating a signal therethrough and including at least a signal delay element;

a driving signal generation step of generating a driving signal by modifying a loop output signal from said loop in accordance with a performance parameter and supplying the generated driving signal to said loop; and a fluctuating-signal generation step of generating a fluctuating signal containing a frequency component corresponding to the loop output signal or corresponding to the loop output signal and the performance parameter and supplying the generated fluctuating signal to said loop, wherein a variation time length of the fluctuating signal varies in response to the loop output signal or the loop output signal and the performance parameter.

17. A machine-readable recording medium containing a group of instructions of a program executable by a processor for synthesizing a tone, said program comprising the steps of:

forming a loop for circulating a signal therethrough and including at least a signal delay element;

generating a driving signal by modifying a loop output signal from said loop in accordance with a performance parameter and supplying the generated driving signal to said loop; and generating a fluctuating signal containing a frequency component corresponding to the loop output signal or corresponding to the loop output signal and the performance parameter and supplying the generated fluctuating signal to said loop, wherein a variation time length of the fluctuating signal varies in response to the loop output signal or the loop output signal and the performance parameter.

* * * * *